United States Patent [19]

Montgomery

[11] Patent Number: 4,936,475

[45] Date of Patent: Jun. 26, 1990

[54] THREADED TAMPER INDICATING CLOSURE

[75] Inventor: Gary V. Montgomery, Evansville, Ind.

[73] Assignee: Sunbeam Plastics Corporation, Evansville, Ind.

[21] Appl. No.: 383,356

[22] Filed: Jul. 21, 1989

Related U.S. Application Data

[63] Continuation-in-part of Ser. No. 246,460, Sep. 19, 1988, abandoned.

[51] Int. Cl.[5] ..... B65D 41/34

[52] U.S. Cl. ..... 215/252

[58] Field of Search ..... 215/252

[56] References Cited

U.S. PATENT DOCUMENTS 3,463,341 8/1969 Fields ..... 215/252

4,699,284 10/1987 Wiedmer ..... 215/252 X 4,768,666 9/1988 Kessler ..... 215/252 X

FOREIGN PATENT DOCUMENTS 1298166 5/1962 France ..... 215/252

*Primary Examiner*—Donald F. Norton

*Attorney, Agent, or Firm*—Gifford, Groh, Sprinkle, Patmore and Anderson

[57] ABSTRACT

A tamper indicating closure and closure-container package in which a tamper indicating skirt depends from the bottom of the annular wall of a standard threaded cap. The skirt includes a plurality of equally spaced depending ribs which are joined at their extremities by a flexible ring. The ring and the skirt ribs pass over lugs on the container neck when the cap is being threaded onto the closure. When the cap is being unthreaded, the lugs engage the rings to sever them indicating tampering or prior opening.

13 Claims, 2 Drawing Sheets

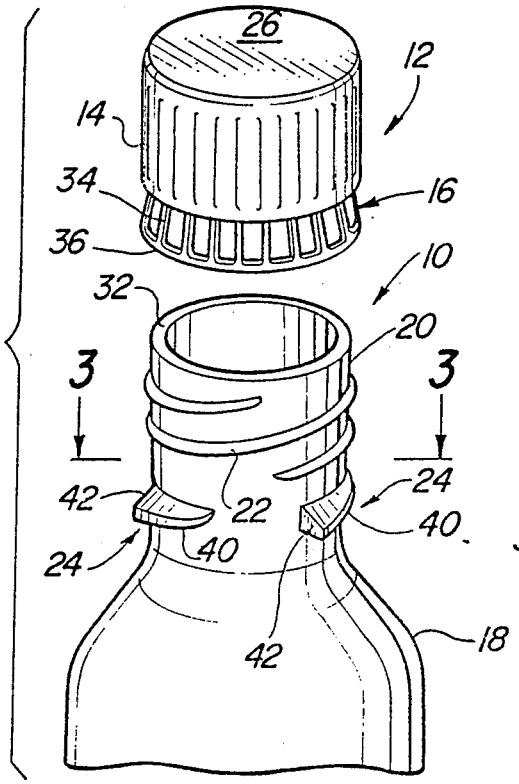
Fig-1
Fig-2
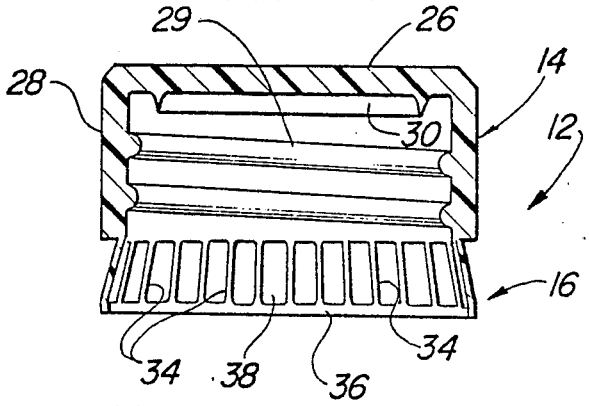
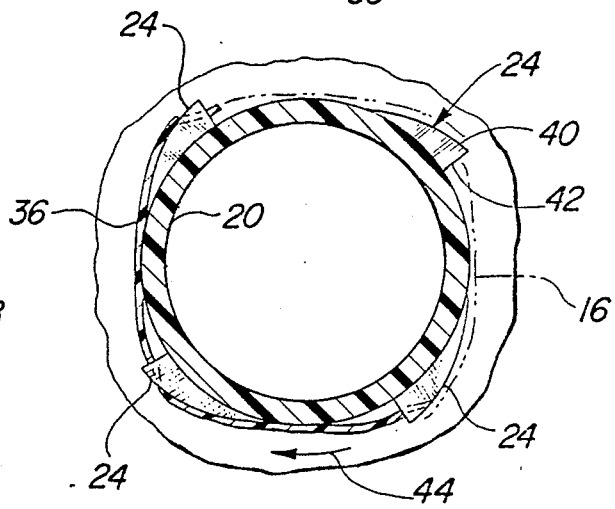
Fig-3
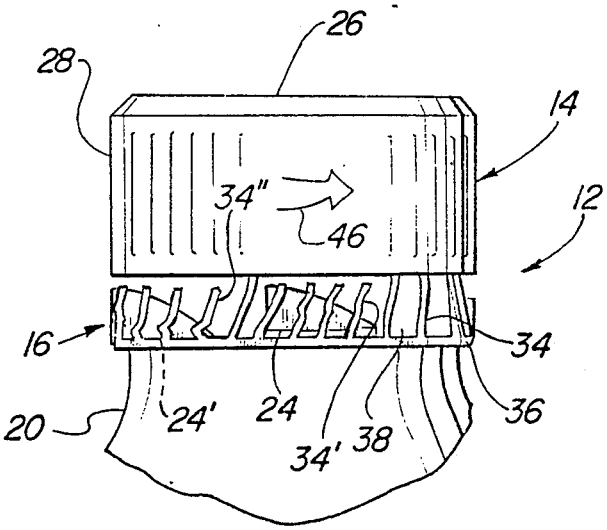
Fig-4
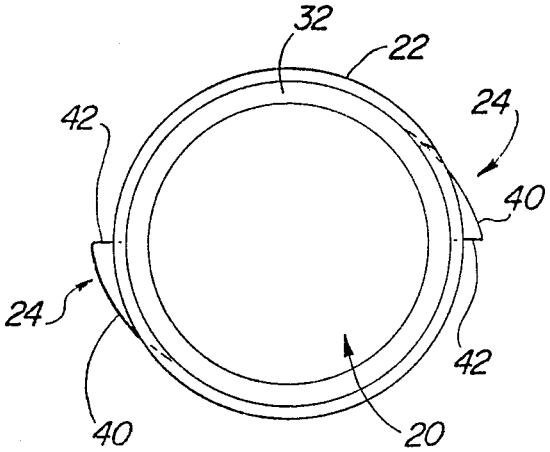
Fig-5

THREADED TAMPER INDICATING CLOSURE

This application is a continuation in part application of my application Ser. No. 246,460, filed Sept. 19, 1988, now abandoned.

This invention relates to tamper indicating packages, and more particularly to an improved tamper indicator which can be added to a standard threaded closure cap.

Tamper indicating container-closure packages are designed to indicate to a prospective purchaser whether or not the original package has been tampered or at least put in the condition for initial opening of the package. Most of these packages rely upon the fracture or removal of an element of the closure. The fracture is usually occasioned by the coaction between the closure and a stop or lug on the container neck.

One of the more popular tamper indicating closures utilizes a tamper indicating band that is connected to the bottom of the cap skirt by a frangible connection. the frangible connection usually takes the form of evenly spaced frangible webs which extend between the bottom of the cap and the band. The band has an inwardly projecting bead at its bottom which cooperates with a stop in the form of a flange or undercut on the container neck. This type of connection is known as a snap bead connection, and it prevents the band from moving upward with the cap as the cap is unthreaded. This causes the frangible webs to break in tension upon initial opening movement of the cap. The band remains with the container neck indicating the prior opening or tampering of the package. The bead on the bottom of the tamper indicating band can be continuous or segmental. In a variation of this closure, the bead is replaced with ratchet teeth on the bottom of the tamper indicating band which coact with similar stops or ratchet teeth on the container neck that prevent rotation on the band during the initial unthreading of the cap, causing failure of the webs in torsion or a combination of tension and shear.

The difficulty experienced with the foregoing type of tamper indicating band is breakage of the frangible webs in the capping process. Thus there has been a considerable amount of effort devoted to designing the cap to minimize this problem of web breakage. One of the more successful closure designs which combats this premature failure of frangible connection is shown in U.S. Pat. No. 4,572,387. Here the frangible webs have a length that allows them to be folded in the capping process. Drive surfaces are presented on the bottom of the cap skirt and the top of the tamper indicating band so that as the cap is initially applied to the threaded container neck, the drive surfaces of the band and cap are brought into contact with each other as the webs are harmlessly folded. Thus the torque necessary to snap the band bead over the container flage is transmitted by the drive surfaces and is not transmitted through the frangible connection. The molding of this closure and any type of closure having a tamper indicating band which is connected to base cap with frangible webs, necessarily requires a costly mold having moveable cam elements for example to form the window spaces between the webs.

The principal advantage of the instant invention is a provision of a tamper indicating element which can be added to a standard threaded cap which does not use a frangible connection subject to failure in the capping process.

Another advantage presented by the instant invention is the simplification of the molding die structure over one involving a typical tamper indicating band connected with frangible webs to the bottom of the cap skirt. This simplification results in a less costly mold.

The foregoing advantages are presented in a tamper indicating closure for use with a container that has a threaded neck and a plurality of radially extending lugs below the threads. The closure has a top and a depending annular wall. The annular wall has internal threads which are engageable with the threaded container neck. A tamper indicating skirt includes a plurality of circumferentially spaced ribs that depend from the cap and a ring which joins each of the ribs, preferably at their extremity.

The tamper indicating skirt can be molded separately from the cap and be snapped onto or welded to the annular cap wall. In the preferred embodiment, however, the tamper indicating skirt is integrally molded with the cap. The ribs depend from the bottom of the annular cap wall preferably diverging outwardly at an angle of approximately 10°. With this structure, the ribs and ring will pass over the container lugs as the cap is threaded onto the container neck. After closing, the lugs are disposed between the ribs and upon unthreading of the cap, the lugs sever the ribs providing evidence of tampering or original opening of the closure.

The closure of this invention provides, with the container, a tamper indicating package. The lugs on the container neck can take the form of a pair of diametrically opposed lugs which extend radially outwardly from the container neck. In the preferred embodiment there ar four equally spaced lugs which circumscribe the container neck. The number of ribs on the tamper indicating skirt can be twelve or more ribs providing that the space between the ribs permits the lug to extend or project radially outwardly between adjacent ribs. The lugs are provided with a cam surface over which the ring and ribs are guided when the cap is being threaded onto the container neck. A radially inward stop surface at the end of the cam surface contacts the ribs as the cap is being unthreaded to sever the ribs in a shear type action to separate the ring from the reamainder of the cap.

The preferred embodiment of the invention is illustrated in the drawing in which:

FIG. 1 is an exploded perspective view showing the closure with a depending tamper indicating skirt as it is applied to the container neck having outwardly extending lugs to provide the tamper indicating package of the invention;

FIG. 2 is an elevational cross-section of the tamper indicating closure of this invention;

FIG. 3 is a cross-sectional view of the container neck and tamper indicating skirt of the closure taken along line 3—3 of FIG. 1;

FIG. 4 is an elevational view of the closure of this invention as it is being unthreaded from the container neck shearing the ribs of the tamper indicating skirt;

FIG. 5 is an end view of the container neck of another embodiment of the invention in which there are only two directly opposed container lugs;

Figure 6:
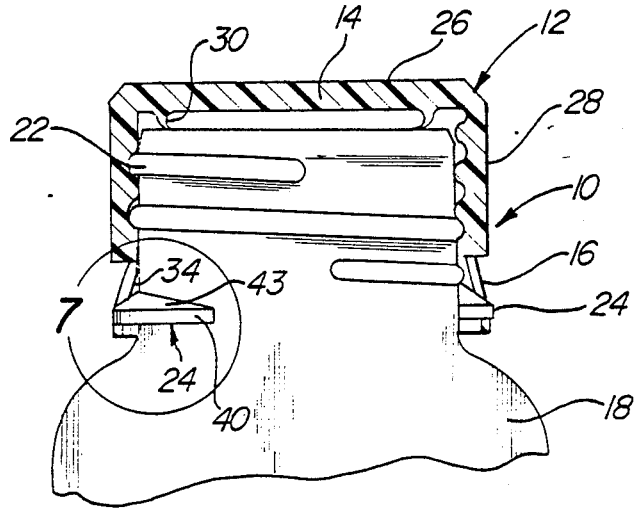
FIG. 6 is a cross-sectional view of the package in a closed condition.
Figure 7:
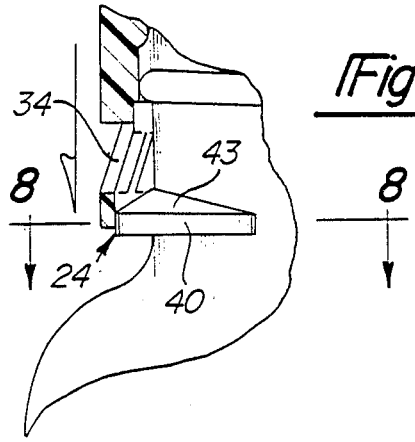
FIG. 7 is an enlargement of a portion shown in FIG. 6 but in a condition existing during closing of the package.

Referring to FIG. 1, the tamper indicating package 10 is shown as including a tamper indicating closure 12 and a container 18. Closure 12 includes a standard threaded cap 14 and a depending tamper indicating skirt 16. Container 18 has a cylindrical neck 20 with an external threads 22 and radially projecting lugs 24 below the threads.

As better seen in FIG. 2 the threaded cap 14 of closure 12 has a planar top 26 and a depending annular wall 28 containing internal threads 29 which are complementary to container neck threads 22 for attaching the closure 12 to the container 18. Annular flange 30 depending from cap top 26 concentric with cap wall 28 seals against container lip 32 as the cap 14 is threaded onto the container neck 20.

The tamper indicating skirt 16 is molded integrally with the threaded cap 14, depending from the bottom of annular cap wall 28 in the formof a plurality of equally spaced depending ribs 34. The ribs are joined at their lower end by a flexible ring 36. While there could be as few as four ribs 34 interconnecting ring 36 with the bottom of the annular cap wall 28, preferably there are at least twelve ribs and more commonly there would be a greater number as shown in FIG. 1 as eighteen ribs and in FIG. 2 as twenty-eight ribs. Ribs 34 are flared outwardly from the inner surface at the bottom of said annular cap wall 28 at an angle of approximately 10° to serve the dual purpose of having the proper contact angle for molding the window spaces 38 between adjacent ribs 34 and to aid in guiding the skirt onto the container neck 20. Also, the ribs are radially inset at their upper ends so that subsequent separation of the ring 36 causes the webs to sever adjacent to the cap wall 38 leaving the webs 34 with the ring 36. This conceals the point of fracture and gives a cleaner appearance to the cap and facilitates subsequent reclosing.

Container neck lugs 24 are evenly spaced around the periphery or circumference of the neck 20 and can be as few as two lugs which are diametrically opposed as shown in FIG. 5. A preferred arrangement is shown in FIGS. 1, 3, and 8 in which there are four lugs 24 equally spaced around the circumference of the neck or at an angle of 90° from each other.

Figure 8:
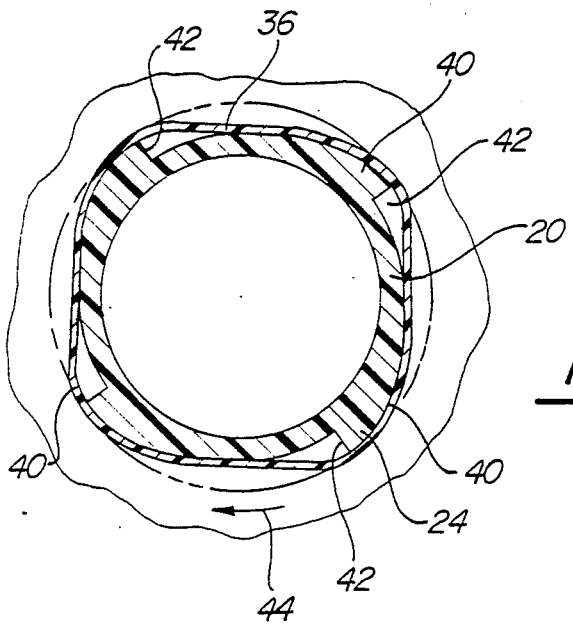
FIG. 8 is a cross-sectional view taken on line 8—8 in FIG. 7 but showing the full neck and ring.

Each of the container neck lugs 24 has a cam surface 40 which extends from the container neck 20 outwardly in a clockwise direction as seen in FIGS. 3 and 8, ending in a radially inward stop surface 42. Additionally, the top surface 43 of the lugs 24 sloped downwardly and outwardly to facilitate guiding of the ring 36 and ribs 34 during application of the closure to the container for the first time. As cap 14 is threaded onto the container neck 20, the tamper indicating skirt passes over the cam surface 40 so that the individual ribs 34 are flexed outwardly until they pass the radial outer end of the stop surface 42. FIG. 8 shows the deflection of the bottom ring 36 of the tamper indicating skirt 36 as the cap 14 is being threaded on in a clockwise direction as shown by arrow 44. Ring 36 is deformed without stretching to form a perimeter line and is shown in the position contacting the outermost portion of all four lugs 24 before the ring edge drops off the cam surface 40 of the stop surface 42 of each lug 24. In the fully closed position of the container, the ring returns toward its circular or as-molded shape. In that position the stop surface 42 of each lug 24 extends into the space 38 between adjacent ribs 34. As the cap 14 is unthreaded, the stop surfaces 42 come into contact with the successive ribs 24 to sever them in shear. This is seen in FIG. 4 as the cap 14 is rotated in a counterclockwise direction indicated by arrow 46, lug 24 successively severs ribs 34' and lug 24' successively severs ribs 34' with parting occuring at the upper end of the ribs 34. When all of the ribs have been severed, the ring 36 and the ribs 34 of tamper indicating skirt 16 will fall down and remain on the container neck 20 indicating tampering or initial opening of the closure.

The tamper indicating skirt can be molded separately as a tamper indicating band which is snapped onto or welded to annular cap wall 28, but preferably it is molded integrally with base cap 14 in a simplified type of mold. In most instances cap threads 29 can be jump threads so that the entire closure 12 can be pulled off of the mold core piece. Preferably closure 12 is molded with a polypropylene plastic to provide maximum strength but also provide the flexibility in the thinner sectioned tamper indicating skirt portion to allow the ring 36 to distort without requiring stretching and the ribs 34 to successively pass over lugs 24. An alternative material could be a high density polyethylene plastic.

The embodiments of the invention in which an exclusive property or privilege is claimed are defined as follows:

1. A tamper indicating closure-container package comprising, in combination:
   - a container having a threaded neck and a plurality of outwardly extending lugs below said threads;
   - a closure cap having a top and a depending annular wall, said annular wall having threads engageable with said threaded neck; and
   - a tamper indicating skirt including a plurality of circumferentially spaced ribs depending from said cap, and a ring joining each of said ribs;
   - said ring being flexible and having a circumferential dimension substantially equal to a perimeter line passing through the radially outer portion of each of said plurality of lugs to flex and pass over said container lugs without stretching when said cap is threaded onto said container neck, said lugs projecting outwardly between said ribs to successively engage and to sever them upon unthreading of said cap to provide evidence of tampering or original opening of said package.

2. The tamper indicating package according to claim 1 wherein said plurality of lugs includes a pair of diametrically opposed lugs extending outwardly from said container neck.

3. The tamper indicating package according to claim 2 wherein said plurality of lugs includes four equally spaced lugs circumscribing said container neck.

4. The tamper indicating package according to claim 2 wherein said tamper indicating skirt includes at least 12 equally spaced ribs.

5. The tamper indicating package according to claim 1 wherein said lugs are provided with a cam surface over which said flexible ring slides when said cap is being threaded onto said container neck.

6. The tamper indicating package according to claim 5 wherein said lugs are provided with a radially extending surface at the end of the cam surface for engaging the ribs when the cap is being unthreaded causing the ribs to be severed in shear.

7. The tamper indicating package according to claim 1 wherein said tamper indicating skirt is integrally molded with said cap.

8. The tamper indicating package according to claim 1 wherein said ribs diverge outwardly from the bottom of said annular cap wall.

9. The tamper indicating package according to claim 8 wherein said ribs diverge outwardly from the bottom of said annular cap wall at an angle or approximately 10°.

10. The tamper indicating closure according to claim 1 wherein said ribs are equally spaced.

11. The tamper indicating closure according to claim 10 wherein said tamper indicating skirt includes at least 12 ribs.

12. The tamper indicating package according to claim 8 wherein said ribs extend from the inner surface of said annular cap wall.

13. The tamper indicating package according to claim 12 wherein said ribs become severed adjacent the inner surface of said annular wall upon unthreading of said cap.

* * * * *